US010974101B2

(12) United States Patent
Becktor et al.

(10) Patent No.: US 10,974,101 B2
(45) Date of Patent: Apr. 13, 2021

(54) COUPLINGS FOR SECURING GOLF SHAFT TO GOLF CLUB HEAD

(71) Applicant: SUMITOMO RUBBER INDUSTRIES, LTD., Kobe (JP)

(72) Inventors: Mika Becktor, Costa Mesa, CA (US); Dustin Brekke, Fountain Valley, CA (US); Jacob Lambeth, Irvine, CA (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/570,163

(22) Filed: Sep. 13, 2019

(65) Prior Publication Data

US 2020/0001144 A1 Jan. 2, 2020

Related U.S. Application Data

(63) Continuation of application No. 15/625,526, filed on Jun. 16, 2017, now Pat. No. 10,449,422.

(51) Int. Cl.

| | |
|---|---|
| ***A63B 53/02*** | (2015.01) |
| ***A63B 60/54*** | (2015.01) |
| *A63B 53/00* | (2015.01) |
| *A63B 102/32* | (2015.01) |

(52) U.S. Cl.

CPC ..... *A63B 53/02* (2013.01); *A63B 60/54* (2015.10); *A63B 53/007* (2013.01); *A63B 2102/32* (2015.10); *A63B 2209/00* (2013.01)

(58) Field of Classification Search

CPC ..... A63B 53/02; A63B 60/54; A63B 53/007; A63B 2209/00; A63B 2102/32

See application file for complete search history.

(56) References Cited

U.S. PATENT DOCUMENTS

| | | | |
|---|---|---|---|
| 2,219,670 | A | 10/1940 | Wettlaufer |
| 4,207,404 | A | 6/1980 | Coran et al. |
| 5,137,275 | A | 8/1992 | Nelson |
| 5,253,867 | A | 10/1993 | Gafner |

(Continued)

FOREIGN PATENT DOCUMENTS

JP H09-103520 A 4/1997

OTHER PUBLICATIONS

Apr. 27, 2018 Office Action issued in U.S. Appl. No. 15/625,526.

(Continued)

*Primary Examiner* — Stephen L Blau
(74) *Attorney, Agent, or Firm* — Oliff PLC

(57) ABSTRACT

A coupling for securing a golf shaft to a golf club head includes a first component configured to contact, and engage with, the golf shaft, and a second component bonded to the first component and configured to space the first component from the golf club head. The second component includes a second material having a Young's modulus less than a first material of the first component. In another aspect, a coupling includes a shaft engagement element, and a spacer configured to space the first component from the golf club head so that the golf shaft is above the golf club head in its entirety. The spacer includes a material having a Young's modulus no greater than about 10 Gpa. In another aspect, a kit includes a first coupling and a second coupling with at least one of a structural configuration or a material of a vibration dampening element differing.

16 Claims, 9 Drawing Sheets

(56) References Cited

U.S. PATENT DOCUMENTS

| | | | | |
|---|---|---|---|---|
| 5,390,921 | A | 2/1995 | De Ruyter | |
| 5,465,959 | A | 11/1995 | Cheng | |
| 5,766,089 | A | 6/1998 | Dekura | |
| 5,904,626 | A | 5/1999 | Fendel et al. | |
| 6,203,446 | B1 * | 3/2001 | Collins | A63B 53/02 473/313 |
| 6,203,447 | B1 | 3/2001 | Dillard | |
| 6,244,976 | B1 | 6/2001 | Murphy et al. | |
| 6,343,999 | B1 | 2/2002 | Murtland et al. | |
| 6,352,482 | B1 | 3/2002 | Jacobson et al. | |
| 6,364,787 | B1 | 4/2002 | Huiskamp | |
| 6,503,151 | B2 | 1/2003 | Kosovac | |
| 6,634,958 | B1 | 10/2003 | Kusumoto | |
| 6,743,116 | B2 | 6/2004 | Wilbur | |
| 6,871,770 | B2 * | 3/2005 | Li | B23K 20/106 156/580.1 |
| 7,226,364 | B2 | 6/2007 | Helmstetter | |
| 7,326,126 | B2 | 2/2008 | Holt et al. | |
| 7,335,113 | B2 * | 2/2008 | Hocknell | A63B 53/00 473/307 |
| 7,704,158 | B2 | 4/2010 | Burrows | |
| 7,857,709 | B2 | 12/2010 | Burch | |
| 7,892,105 | B2 | 2/2011 | Galloway | |
| 8,119,744 | B2 | 2/2012 | Morita et al. | |
| 8,523,700 | B2 * | 9/2013 | Sander | A63B 53/02 473/288 |
| 8,562,454 | B2 | 10/2013 | Burch | |
| 8,585,511 | B2 | 11/2013 | Sato et al. | |
| 8,632,417 | B2 * | 1/2014 | Sander | A63B 53/00 473/307 |
| 8,696,486 | B1 * | 4/2014 | Aguinaldo | A63B 60/42 473/307 |
| 9,105,863 | B2 * | 8/2015 | Goeoetz | H01L 25/048 |
| 9,168,435 | B1 | 10/2015 | Boggs et al. | |
| 9,345,935 | B2 * | 5/2016 | Yamamoto | A63B 53/00 |
| 9,387,378 | B2 * | 7/2016 | Shimono | A63B 60/00 |
| 9,757,627 | B2 * | 9/2017 | Galvan | A63B 53/02 |
| 9,931,552 | B2 * | 4/2018 | Yoshihiro | A01K 87/00 |
| 2007/0270237 | A1 * | 11/2007 | Tavares | A63B 53/10 473/349 |
| 2011/0111881 | A1 * | 5/2011 | Sander | A63B 53/0466 473/307 |
| 2016/0144246 | A1 | 5/2016 | Oniuki et al. | |
| 2020/0206591 | A1 * | 7/2020 | Nielson | A63B 60/52 |

OTHER PUBLICATIONS

Oct. 18, 2018 Office Action issued in U.S. Appl. No. 15/625,526.
Jun. 13, 2019 Notice of Allowance issued in U.S. Appl. No. 15/625,526.

* cited by examiner

COUPLINGS FOR SECURING GOLF SHAFT TO GOLF CLUB HEAD

This is a Continuation of application Ser. No. 15/625,526 filed Jun. 16, 2017. The prior application, including the specification, drawings and abstract are incorporated herein by reference in their entirety.

BACKGROUND

Golf equipment designers traditionally have been interested in improving the "feel" of a golf club head, "feel" being the combination of impact effects between a golf club and a golf ball capable of being sensed by the golfer. The feel of a golf club can include at least in part vibrations emanating through the golf club when contacting the golf ball. These vibrations can be particularly apparent to the golfer when using a putter, which may involve a generally slower and more finely controlled motion than when using other types of golf clubs.

The materials used for a golf club (or club head) or the total weight of a golf club (or club head) may provide a softer or harder feel when striking a golf ball. For this reason, some putters may include an insert material on a striking face of the golf club head that is made of a different material than a remaining portion of the golf club head, or may include a milled striking face to give the putter a softer feel upon impact with a golf ball. Golfers may also add tape, such as a lead tape, to a golf club head to increase the weight of the golf club head and attempt to provide a softer feel when contacting a golf ball. However, such features often fall short of adequately isolating undesirable vibrations resulting from impact and inadequately provide vibration dampening in a manner tailorable to a particular golfer or class of golfer.

BRIEF DESCRIPTION OF THE DRAWINGS

The features and advantages of the embodiments of the present disclosure will become more apparent from the detailed description set forth below when taken in conjunction with the drawings. The drawings and the associated descriptions are provided to illustrate embodiments of the disclosure and not to limit the scope of what is claimed.

DETAILED DESCRIPTION

In the following detailed description, numerous specific details are set forth to provide a full understanding of the present disclosure. It will be apparent, however, to one of ordinary skill in the art that the various embodiments disclosed may be practiced without some of these specific details. In other instances, well-known structures and techniques have not been shown in detail to avoid unnecessarily obscuring the various embodiments.

Figure 1A:
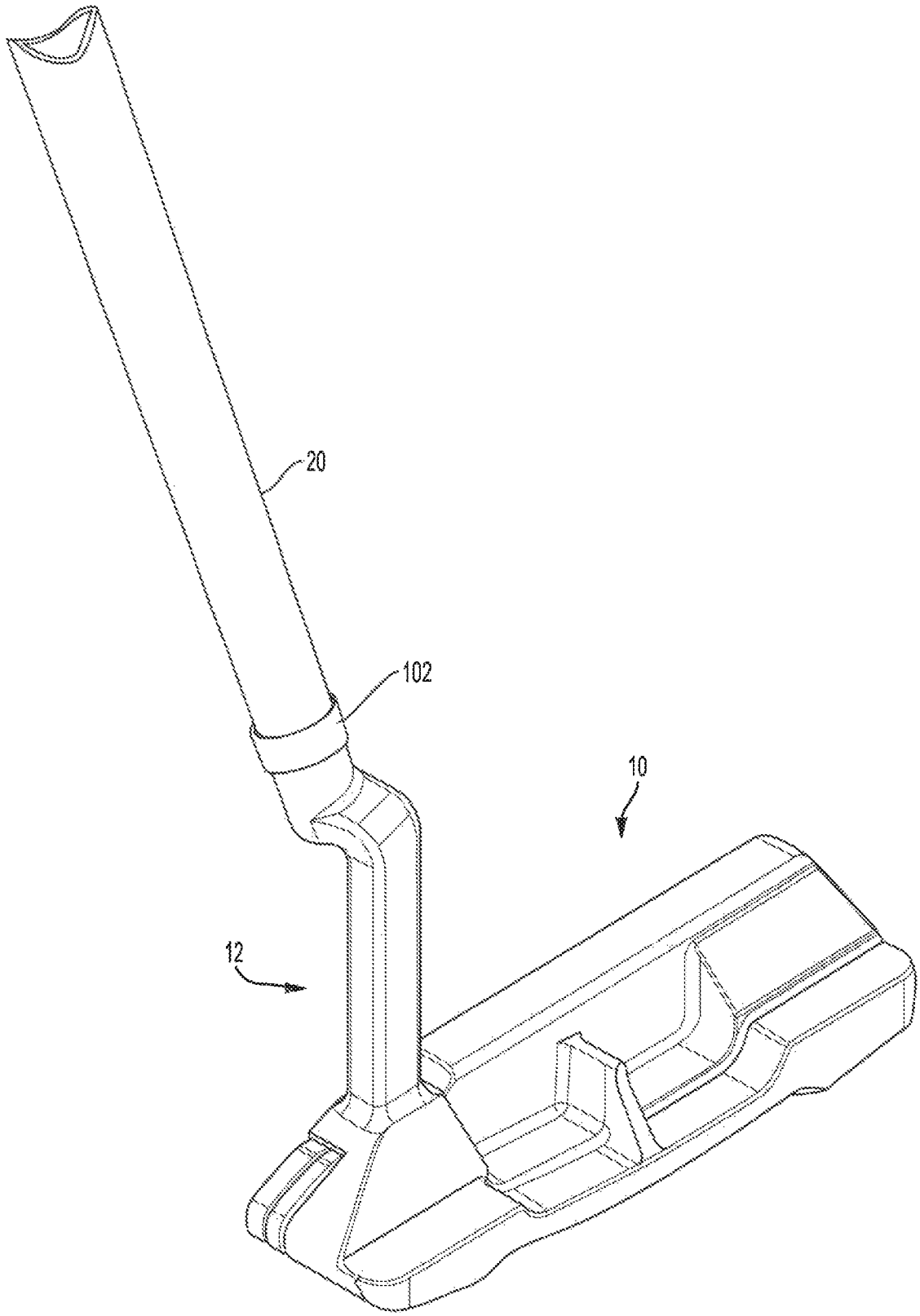
FIG. 1A is a partial perspective view of a golf club including a golf shaft and a golf club head according to an embodiment.

FIG. 1A is a partial perspective view of a golf club including golf shaft 20 and golf club head 10 according to an embodiment. As shown in FIG. 1A, golf shaft 20 is coupled to hosel 12 of golf club head 10. In addition, spacer 102 acts to space golf club head 10 from golf shaft 20 so that when operably secured to golf shaft 20, a majority of, and preferably an entirety of, an exterior surface of the golf shaft 20 isolated from the interior surface of the hosel 12 of the golf club head 10. As will be discussed in more detail below, spacer 102 can serve as a hosel sleeve that acts as a vibration dampening element between golf club head 10 and golf shaft 20 to attenuate vibrations, preferably high frequency vibrations, excited from impact with a golf ball. This arrangement can ordinarily provide a softer feel perceived by a golfer holding a grip (not shown) of golf shaft 20.

In more detail, spacer 102 can be bonded to an internal shaft engagement element (e.g., engagement element 104 in FIGS. 1B and 1C) configured to engage with golf shaft 20 and provide the coupling 100 with a similar strength and bending stiffness or flexural rigidity to a tip portion of golf shaft 20 (of which it may substitute). A shaft engagement element having comparable bending stiffness to the tip portion of golf shaft 20 can help reduce curvature at the coupling between golf shaft 20 and golf club head 10 when a bending moment is applied to the golf club.

According to beam theory, the relationship between an applied bending moment and the curvature of a beam is:

$$M = EI\frac{d^2w}{dx^2}$$

where M is the bending moment, E is the Young's modulus or elastic modulus of the material, I is the area moment of inertia of the beam cross section about the bending axis, w is the deflection of the beam, and x is the distance along the beam. Accordingly, if a golf club is treated as a beam, the curvature, $$\frac{d^2w}{dx^2},$$

of the golf club at a given cross section due to a moment applied to the golf club is proportional to the product of E and I, which is the bending stiffness at the cross section. The selection of material and treatment of the material (if any) where the golf shaft couples to the golf club head affects the bending stiffness by its Young's modulus, as does the cross-sectional area of the material, which affects the area moment of inertia, I.

In view of the foregoing, it is generally desirable in terms of reducing curvature and possible plastic deformation of a golf club where the golf club head couples to the golf shaft to attempt to match as close as possible the bending stiffness and strength of the coupling to the tip portion of the golf shaft. However, materials typically used for golf shafts for their higher bending stiffness and strength, such as treated steel, do not provide much, if any, vibration dampening due to their relatively high Young's modulus (i.e., stiffness). As discussed in more detail below, the present disclosure includes couplings that provide greater vibration damping for a softer feel, while still providing a bending stiffness and strength comparable to the tip portion of a golf shaft.

Figure 1B:
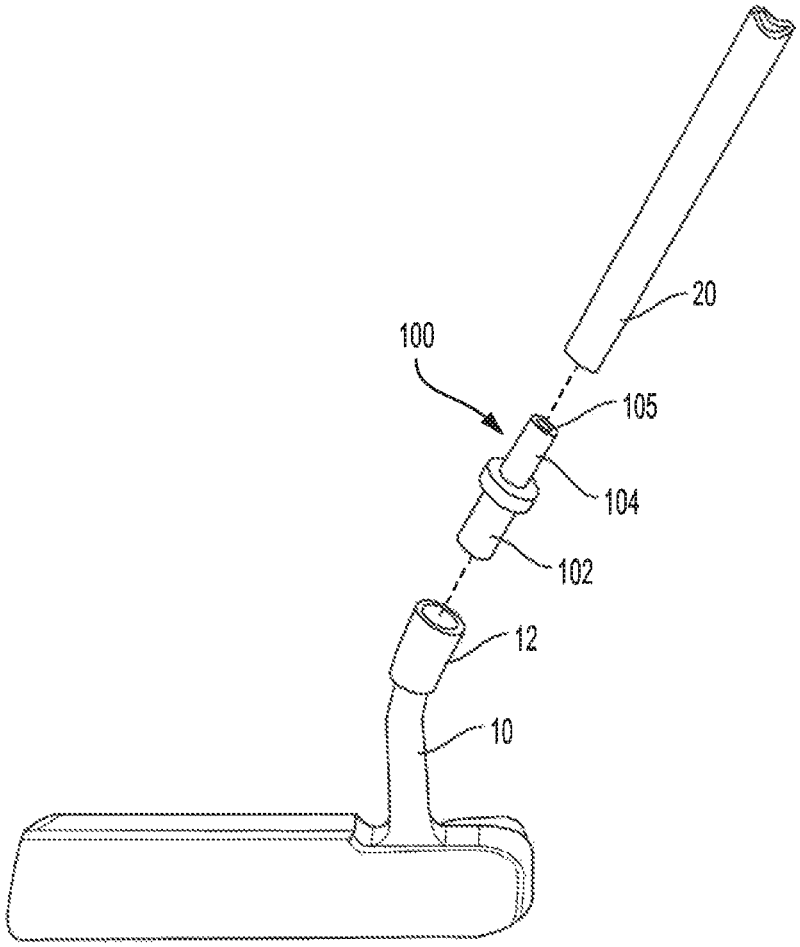
FIG. 1B is an exploded perspective view of the golf club of FIG. 1A depicting a coupling for securing the golf shaft to the golf club head.

FIG. 1B is an exploded perspective view of the golf club in FIG. 1A. As shown in FIG. 1B, golf shaft 20 can be secured to golf club head 10 using coupling 100, which includes a first component, shaft engagement element 104, and a second component, spacer 102. Coupling 100 is configured such that, when operably secured to golf club shaft 20 and golf club head 10, golf shaft 20 is located above the hosel of the golf club head 10 in its entirety. For all purposes herein, unless otherwise stated, "above" and "below" are relative terms to be considered along a directional axis corresponding to the virtual central longitudinal axis of a hosel (e.g. hosel 12) of a golf club head (e.g. club head 10, whereby "up" refers to the direction, along the central longitudinal axis from a sole-touching location of the axis to a hosel tip-touching location of the central longitudinal axis. Accordingly, "above the hosel of the golf club head" corresponds to being upward of the hosel as measured along the central longitudinal hosel axis.

Shaft engagement element 104 is configured to contact, and engage with golf shaft 20, and made of a material having a greater Young's modulus than spacer 102 to provide coupling 100 with a comparable bending stiffness to the tip portion of golf shaft 20. In this regard, shaft engagement element 104 can include a material with a Young's modulus no less than (i.e., greater than or equal to) 30 GPa, more preferably no less than 75 GPa, and even more preferably, no less than 100 GPa. In some examples, shaft engagement element 104 can include a material with a Young's modulus between 100 GPa and 200 GPa. Shaft engagement element 104 can be made of a material, such as steel, stainless steel, titanium, titanium alloy, aluminum, zinc, or copper. In the example of FIG. 1B, shaft engagement element 104 is a hollow pin with internal pin bore 105, but other embodiments may include a solid shaft engagement element, as in the embodiments of FIGS. 6A to 6C and 7A to 7C discussed below.

Spacer 102, on the other hand, is configured to space shaft engagement element 104 from golf club head 10 in an operating position. In addition, spacer 102 comprises a material having a Young's modulus less than the Young's modulus of the material for shaft engagement element 104 to attenuate vibrations excited when golf club head 10 strikes a golf ball. In this regard, spacer 102 can include a material with a Young's modulus no greater than (i.e., less than or equal to) 10 GPa, more preferably no greater than 5 GPa, and even more preferably between 1 GPa and 5 GPa. The material for spacer 102 can include, for example, an elastomer, a natural rubber, a synthetic rubber, a polyurethane (e.g., Sorbothane), an acetal resin (e.g., Derlin), a thermoplastic material (e.g., polyethylene or polypropylene), a polyamide, or a fiber-reinforced resin. In addition, since spacer 102 is exposed to an exterior of the golf club, the material used for spacer 102 can have a hardness of Shore 20D to 70D, or higher, for durability.

In some implementations, a ratio of the Young's modulus of the material for shaft engagement element 104 to the Young's modulus of the material for spacer 102 can be no less than 3. For example, the Young's modulus of the material used for engagement element 104 may be no less than about 30 GPa, and the Young's modulus of the material used for spacer 102 may be no greater than about 10 GPa. More preferably, the ratio of the Young's modulus of the material for shaft engagement element 104 to the Young's modulus of the material for spacer 102 may be no less than 15. Even more preferably, the ratio of the Young's modulus of the material for shaft engagement element 104 to the Young's modulus of the material for spacer 102 may be no less than 25.

In some examples, engagement element 104 can include a titanium alloy with a Young's modulus of 105 to 120 GPas or steel with a Young's modulus of 180 to 200 GPa. Spacer 102, in contrast, can include a plastic material with a Young's modulus of 1 GPa to 3 GPa, an aramid material with a Young's modulus of 70 to 112 GPa, or a composite material with a Young's modulus of 150 GPa.

Figure 1C:
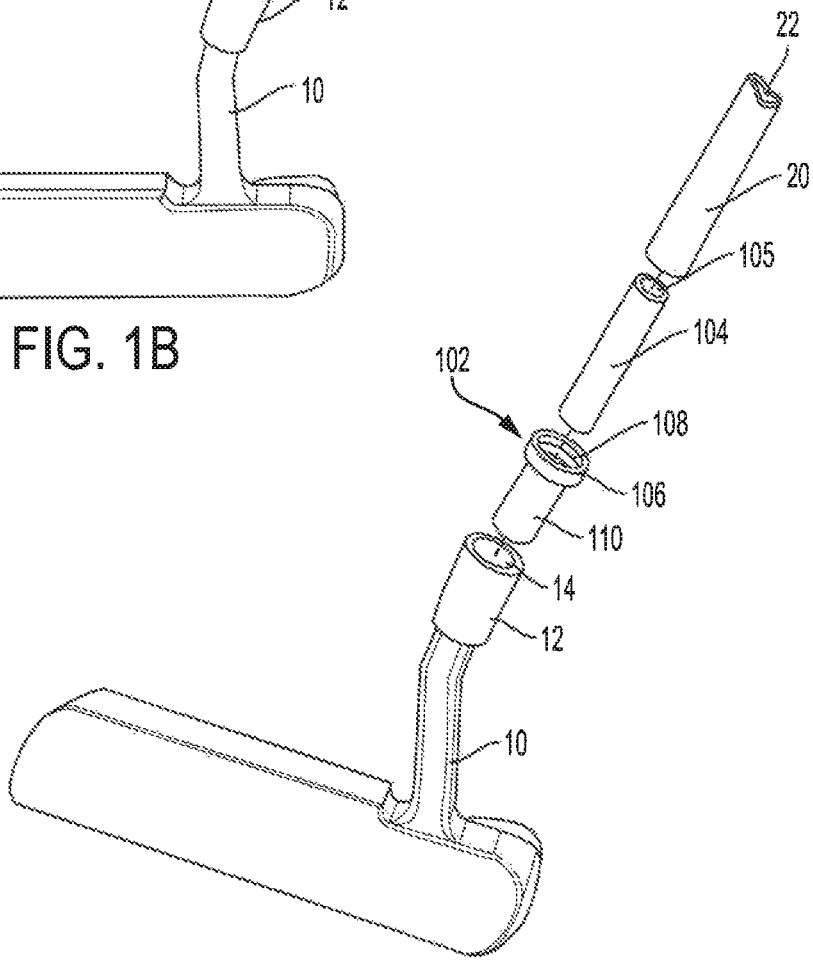
FIG. 1C is a further exploded perspective view of the golf club of FIGS. 1A and 1B depicting components of the coupling in more detail.

FIG. 1C is a further exploded perspective view of the golf club of FIGS. 1A and 1B depicting the components of coupling 100 in more detail. As shown in FIG. 1C, shaft engagement element 104 is configured to fit within shaft internal bore 22 of golf shaft 20. In some implementations, the inner diameter of the shaft internal bore 22 may be increased as compared to conventional golf shafts to allow for a larger outer diameter or cross-sectional area of shaft engagement element 104. Increasing the cross-sectional area of shaft engagement element 104 can allow for a greater bending stiffness by increasing its area moment of intertia, I, as discussed above. Shaft engagement element 104 may be bonded, for example, by chemically adhering shaft engagement element 104 into shaft internal bore 22 using an epoxy resin. In other implementations, shaft engagement element 104 may be frictionally fitted into shaft internal bore 22. Such frictional fitting implementations may allow for the addition and removal of coupling 100 or a golf club shaft by a golfer or retailer in the field.

Similarly, spacer 102 is configured to fit within hosel internal bore 14 of hosel 12 with hosel engagement portion 110 of spacer 102 fitting within hosel internal bore 14. In some implementations, a diameter of hosel internal bore 14 may be increased as compared to conventional hosels to allow for more of the vibration dampening material of spacer 102. Hosel engagement portion 110 may be bonded by, for example, chemically adhering hosel engagement portion 110 into hosel internal bore 14 using e.g. an epoxy resin. In other implementations, hosel engagement portion 110 may be frictionally fitted into hosel 12. Such frictional fitting implementations may allow for the addition and removal of coupling 100 by a golfer or retailer in the field.

An outer sleeve portion 106 of spacer 102 extends radially from a hosel engagement portion 110 of spacer 102 and is located between hosel 12 and golf shaft 20 when assembled into an operating position. This arrangement allows outer sleeve portion 106 to prevent hosel 12 from directly contacting golf shaft 20, which can help dampen vibrations emanating from golf club head 10 to golf shaft 20.

Figure 2A:
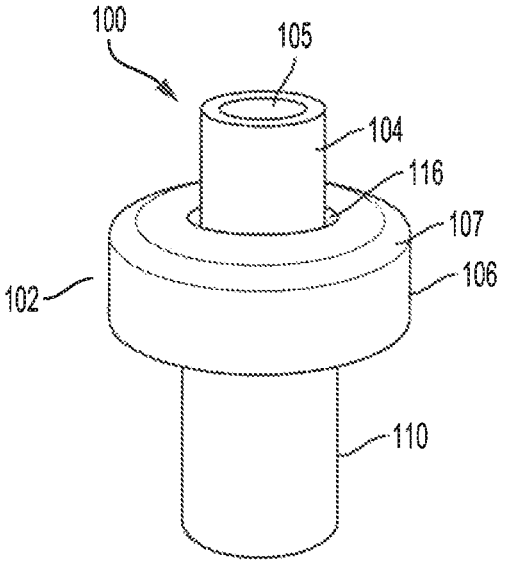
FIG. 2A is a perspective view of the coupling of FIGS. 1B and 1C.
Figure 2B:
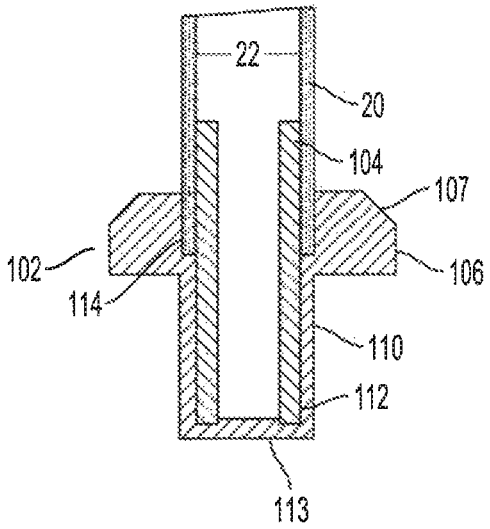
FIG. 2B is a cross-section view of the coupling of FIG. 2A taken through its central longitudinal axis and in contact with the golf shaft.

FIG. 2A is a perspective view of coupling 100 from FIGS. 1B and 1C in isolation. FIG. 2B is a cross-section view of coupling 100 along cross-section line 2B in FIG. 2A when in contact with golf shaft 20. As shown in FIGS. 2A and 2B, coupling 100 includes annular groove 116 between shaft engagement element 104 and spacer 102 for receiving and securing golf shaft 20. In addition, outer sleeve portion 106 of spacer 102 includes chamfer 107 to provide a safer, more durable, and/or more aesthetic construction for outer sleeve portion 106, which is exposed on an exterior of the golf club when it is assembled in the operating position shown in FIG. 1A.

As shown in FIG. 2B, spacer 102 shrouds or encircles a lower portion of shaft engagement element 104, and also shrouds or encircles a tip portion of golf shaft 20 where shaft engagement element 104 and the tip portion of golf shaft 20 overlap. Spacer 102 can be bonded to shaft engagement element 104 and golf shaft 20. In some implementations, spacer 102 may be bonded to shaft engagement element 104 by co-molding spacer 102 with shaft engagement element during a molding process. In other implementations, spacer 102 may be bonded to shaft engagement element 104 by gluing spacer 102 to shaft engagement element 104. Spacer 102 may be bonded to golf shaft 20, for example, by glue (e.g., an epoxy glue).

Shaft engagement element 104 fits within shaft internal bore 22 of golf shaft 20 with the tip portion of golf shaft 20 interiorly contacted or supported by shaft engagement element 104 and exteriorly contacted or supported by lateral shaft support surface 114 of spacer 102. Shaft engagement element 104 is also in contact with base 113 of spacer 102 and interior surface 112 of hosel engagement portion 110 of spacer 102. Indentations in base 113 of spacer 102 can provide better engagement between shaft engagement element 104 and spacer 102.

A wall thickness of spacer 102 encircling shaft engagement element 104 (e.g., hosel engagement portion 110) may be selected in some implementations to allow for a larger outer diameter of shaft engagement element 104 for a greater bending stiffness. However, the thinness of a wall of spacer 102 encircling shaft engagement element 104 may also be balanced against the amount of vibration dampening material in spacer 102 to meet, for example, a vibration damping design specification.

The foregoing arrangement of shaft engagement element 104, spacer 102, and golf shaft 20 can ordinarily provide a sufficiently strong and stiff coupling between golf shaft 20 and golf club head 10 via shaft engagement element 104, while isolating golf shaft 20 from golf club head 10 via spacer 102 to serve as a vibration dampening element. In this regard, coupling 100 isolates golf shaft 20 in its entirety from golf club head 10 when in an operating position with golf shaft 20 located above golf club head 10 in its entirety.

Figure 3A:
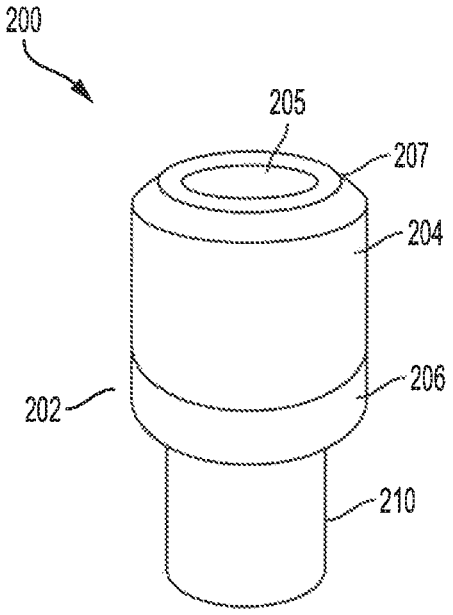
FIG. 3A is a perspective view of a coupling for securing a golf shaft to a golf club head according to an embodiment.
Figure 3B:
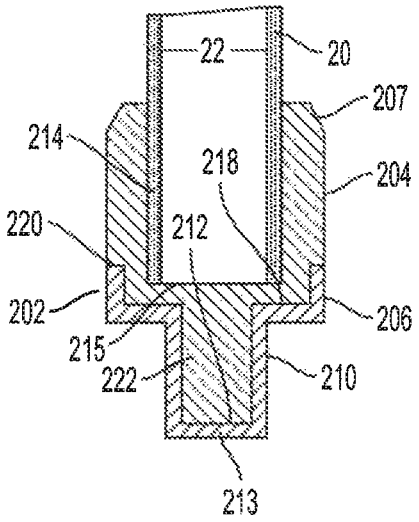
FIG. 3B is a cross-section view of the coupling of FIG. 3A taken through its central longitudinal axis and in contact with a golf shaft.

FIG. 3A is a perspective view of coupling 200 for securing golf shaft 20 to golf club head 10 according to an embodiment. FIG. 3B provides a cross-section view of coupling 200 along cross-section line 3B when in contact with golf shaft 20. As shown in FIGS. 3A and 3B, coupling 200 includes shaft engagement element 204 and spacer 202 bonded to shaft engagement element 204 to isolate golf shaft 20 from a golf club head (e.g., golf club head 10 in FIGS. 1A to 1C). In this regard, coupling 200 isolates golf shaft 20 in its entirety from a golf club head when in an operating position with golf shaft 20 located above the golf club head in its entirety. Spacer 202 may be bonded to shaft engagement element 204 by co-molding spacer 202 with shaft engagement element 204 during a molding process. In other implementations, spacer 202 may be bonded to shaft engagement element 204 by, for example, glue.

As with shaft engagement element 104 and spacer 102 of coupling 100 in FIGS. 2A and 2B discussed above, the material used for spacer 202 in coupling 200 can include a material having a lower Young's modulus than the material of shaft engagement element 204 to attenuate vibration from when the golf club head strikes a golf ball. The same ratios, limits, and preferred ranges for the Young's moduli of the materials used for spacer 102 and shaft engagement element 104 discussed above for coupling 100 may be used in selecting materials for spacer 202 and shaft engagement element 204 of coupling 200. For example, the material for shaft engagement element 204 may be selected from steel, stainless steel, titanium, titanium alloy, aluminum, zinc, and copper. Similarly, the material for spacer 202 may be selected from an elastomer, a natural rubber, a synthetic rubber, a polyurethane, an acetal resin, a thermoplastic material, a polyamide, and a fiber-reinforced resin. As with coupling 200 in FIGS. 2A and 2B, coupling 300 in FIGS. 3A and 3B is at least partially hollow with sleeve internal bore 205, which receives and secures golf shaft 20.

As shown in FIGS. 3A and 3B, coupling 200 differs from coupling 100 in one aspect in that shaft engagement portion 204 is exposed to an exterior of the golf club and externally shrouds or encircles the tip portion of golf shaft 20 instead of fitting within shaft internal bore 22. Shaft engagement portion 204 includes chamfer 207 to provide a safer, more durable, and/or more aesthetic construction for shaft engagement portion 204, which is exposed on an exterior of the golf club when it is assembled in the operating position.

In another aspect, coupling 200 differs from coupling 100 in FIGS. 2A and 2B in that shaft engagement element 204 constitutes a female-type mating element complementary to the male-type mating element constituted by the tip end of the shaft 20 (whereas the shaft engagement element 104 of the coupling 100 is solely insertable within the interior bore of the tip end of shaft 20). In addition, the coupling 200 vertically supports or contacts golf shaft 20 at base 215 instead of spacer 202 vertically supporting or contacting golf shaft 20.

In yet another aspect, coupling 200 differs from coupling 100 in FIGS. 2A and 2B in that spacer 202 shrouds or encircles a smaller portion of shaft engagement element 204 that overlaps golf shaft 20. Instead, more structural support is provided externally from shaft engagement element 204. Coupling 200 may therefore provide for a greater bending stiffness and/or strength than coupling 100 when using the same materials as for shaft engagement element 104 and spacer 102, since shaft engagement element 204 has a greater radial area than shaft engagement element 104 for the same size golf shaft 20. In addition, hosel engagement portion 210 of spacer 202 is filled by insert portion 222 of shaft engagement element 204 to provide additional strength and bending stiffness to coupling 200 than the hollow center of hosel engagement portion 110 in FIGS. 2A and 2B. Shaft engagement element 204 is also vertically supported or contacted by additional internal surfaces of spacer 202, with support surfaces 220, 218, and 212 providing vertical support or contact between spacer 202 and shaft engagement element 204. In terms of material properties, shaft engagement element 204 preferably comprises attributes similar to those described with regard to the like shaft engagement element 104 of the embodiment of FIG. 1, whereas spacer 202 preferably comprises attributes similar to those described with regard to the like spacer 102 of the embodiment of FIG. 1.

Figure 4A:
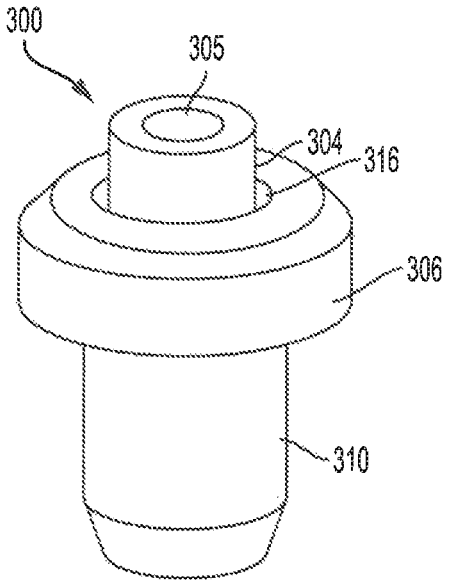
FIG. 4A is a perspective view of a coupling for securing a golf shaft to a golf club head according to an embodiment.
Figure 4B:
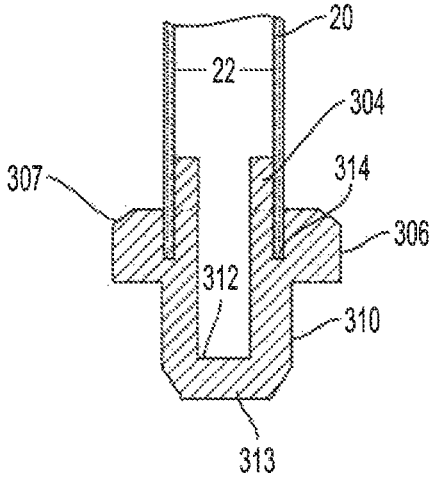
FIG. 4B is a cross-section view of the coupling of FIG. 4A taken through its central longitudinal axis and in contact with a golf shaft.

FIG. 4A is a perspective view of coupling 300 for securing golf shaft 20 to golf club head 10 according to an embodiment. FIG. 4B provides a cross-section view of coupling 300 along cross-section line 4B when in contact with golf shaft 20. As shown in FIGS. 4A and 4B, coupling 300 is similar to coupling 100 in its receiving and securing of golf shaft 20 between shaft engagement portion 304 and outer sleeve portion 306 in annular groove 316 of coupling 300. However, coupling 300 differs from couplings 100 and 200 discussed above in that coupling 300 is made from a single material.

As shown in FIGS. 4A and 4B, outer sleeve portion 306 of coupling 300 includes chamfer 307 to provide a safer, more durable, and/or more aesthetic construction for outer sleeve portion 306, which is exposed on an exterior of the golf club when it is assembled in an operating position. Outer sleeve 306 shrouds or encircles a lower portion of shaft engagement portion 304, and also shrouds or encircles a tip portion of golf shaft 20 where shaft engagement portion 304 and the tip portion of golf shaft 20 overlap. Shaft engagement portion 304 fits within shaft internal bore 22 of golf shaft 20 with the tip portion of golf shaft 20 interiorly contacted or supported by shaft engagement portion 304 and exteriorly contacted or supported by lateral shaft support surface 314. Hosel engagement portion 310 is configured to fit within a hosel internal bore (e.g., hosel internal bore 14 in FIG. 1C), and includes base 313. In the example of FIGS. 4A and 4B, coupling 300 is hollow in that sleeve internal bore 305 is open and internal base surface 312 does not contact another material.

The foregoing arrangement of coupling 300 can allow for a simplified and/or less expensive construction for coupling 300 than for couplings 100 and 200 discussed above, since coupling 300 is made of a single material and may be made of a single component. In addition, coupling 300 can still provide for vibration dampening by selecting a material that has a high enough strength for structural integrity and a Young's modulus for both sufficient bending stiffness (as compared to the tip portion of golf shaft 20) and vibration dampening. A material for coupling 300 can include, for example, a material with a Young's modulus that is less than the Young's modulus for the material used for golf club head 10. In this regard, coupling 300 isolates golf shaft 20 in its entirety from golf club head 10 when in an operating position with golf shaft 20 located above golf club head 10 in its entirety.

Figure 5A:
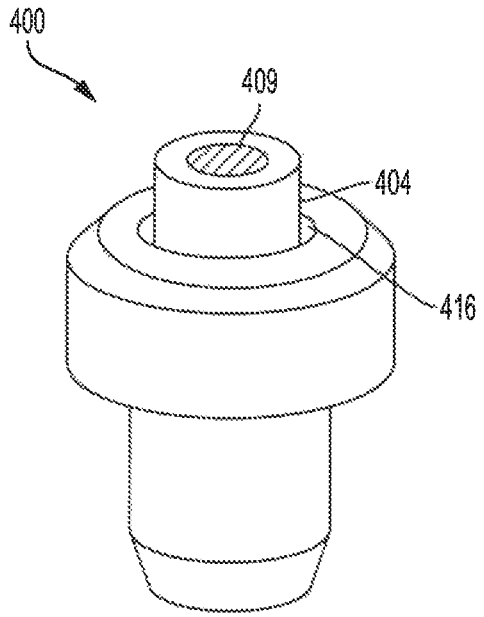
FIG. 5A is a perspective view of a coupling for securing a golf shaft to a golf club head according to an embodiment.
Figure 5B:
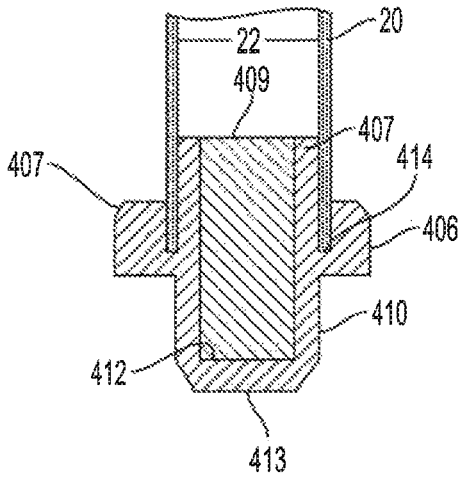
FIG. 5B is a cross-section view of the coupling of FIG. 5A taken through its central longitudinal axis and in contact with a golf shaft.

FIG. 5A is a perspective view of coupling 400 for securing golf shaft 20 to golf club head 10 according to an embodiment. FIG. 5B provides a cross-section view of coupling 400 along cross-section line 5B when in contact with golf shaft 20. As shown in FIGS. 5A and 5B, coupling 400 is similar to coupling 100 in its receiving and securing of golf shaft 20 between shaft engagement portion 404 and outer sleeve portion 406 in annular groove 416 of coupling 400.

As shown in FIGS. 5A and 5B, coupling 400 differs from coupling 300 in FIGS. 4A and 4B in that insert element 409 fills an internal space defined by an internal surface of shaft engagement portion 404 and internal base surface 412 of base 413. In some implementations, insert element 409 can be bonded to a remaining portion of coupling 400 by co-molding insert element 409 with the remaining portion of coupling 400 during a molding process. In other implementations, insert element 409 can be bonded to the remaining portion of coupling 400 with glue.

The addition of insert element 409 can ordinarily increase the strength and bending stiffness of coupling 400, which may allow for the selection of a material for the remaining portion of coupling 400 that has a lower Young's modulus to provide improved vibration dampening.

As shown in FIGS. 5A and 5B, outer sleeve portion 406 of coupling 400 includes chamfer 407 to provide a safer, more durable, and/or more aesthetic construction for outer sleeve portion 406, which is exposed on an exterior of the golf club when it is assembled in an operating position. Outer sleeve portion 406 shrouds or encircles a lower portion of shaft engagement portion 404, and also shrouds or encircles a tip portion of golf shaft 20 where shaft engagement portion 404 and the tip portion of golf shaft 20 overlap. Shaft engagement portion 404 fits within shaft internal bore 22 of golf shaft 20 with the tip portion of golf shaft 20 interiorly contacted or supported by shaft engagement portion 404 and exteriorly contacted or supported by lateral shaft support surface 414. Hosel engagement portion 410 is configured to fit within a hosel internal bore (e.g., hosel internal bore 14 in FIG. 1C), and includes base 413. In terms of material properties, shaft engagement element 404 preferably comprises attributes similar to those described with regard to the like shaft engagement element 104 of the embodiment of FIG. 1, whereas insert element 409 preferably comprises attributes similar to those described with regard to the like spacer 102 of the embodiment of FIG. 1.

Figure 6A:
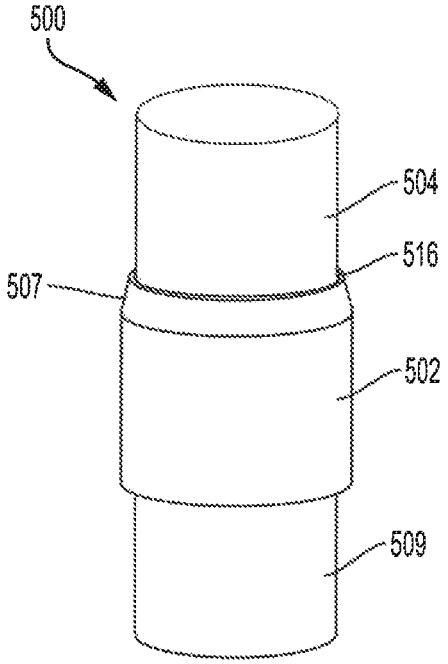
FIG. 6A is a perspective view of a coupling for securing a golf shaft to a golf club head according to an embodiment.
Figure 6B:
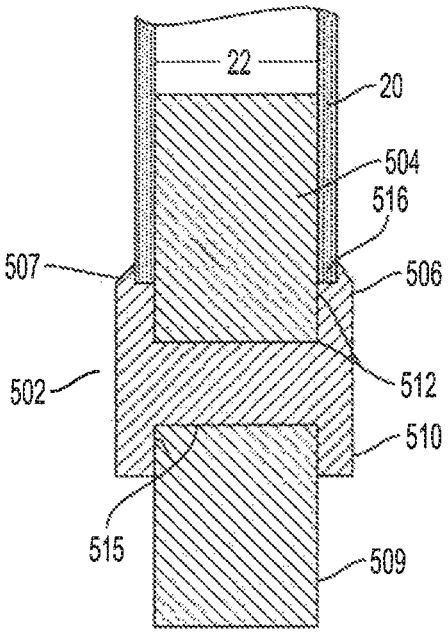
FIG. 6B is a cross-section view of the coupling of FIG. 6A taken through its central longitudinal axis and in contact with a golf shaft

FIG. 6A is a perspective view of coupling 500 for securing golf shaft 20 to golf club head 10 according to an embodiment. FIG. 6B provides a cross-section view of coupling 500 along cross-section line 5B when in contact with golf shaft 20. As shown in FIGS. 6A and 6B, coupling 500 includes shaft engagement element 504, spacer 502, and a third component, hosel insert 509. In some implementations, hosel insert 509 can be made of a material with a different Young's modulus than the materials used for spacer 502 and/or shaft engagement element 504. In such implementations, the Young's modulus of the material used for hosel insert 509 can be greater than the Young's modulus of the material used for spacer 502 to provide for added bending stiffness in the connection between coupling 500 and the hosel. In addition, the material used for hosel insert 509 may be selected for better adhesion or frictional fit with the hosel, such as by using a metal material to contact a metal material of the hosel. In some implementations, hosel insert 509 and shaft engagement element 504 may be made of the same material.

As with shaft engagement element 104 and spacer 102 of coupling 100 in FIGS. 2A and 2B discussed above, the material used for spacer 502 can have a lower Young's modulus than the Young's modulus for a material used for shaft engagement element 504. The same ratios, limits, and preferred ranges for the Young's moduli of the materials used for spacer 102 and shaft engagement element 104 discussed above for coupling 100 may be used in selecting materials for spacer 502 and shaft engagement element 504 of coupling 500. For example, the material for shaft engagement element 504 may be selected from steel, stainless steel, titanium, titanium alloy, aluminum, zinc, and copper. Similarly, the material for spacer 502 may be selected from an elastomer, a natural rubber, a synthetic rubber, a polyurethane, an acetal resin, a thermoplastic material, a polyamide, and a fiber-reinforced resin.

Spacer 502 may be bonded to shaft engagement element 504 and hosel insert 509 by co-molding spacer 502 with shaft engagement element 504 and hosel insert 509 during a molding process. In other implementations, spacer 502 may be bonded to shaft engagement element 504 and hosel insert 509 by, for example, gluing along interior surfaces 512 and 515 of spacer 502.

As shown in FIGS. 6A and 6B, coupling 500 includes annular groove 516 between shaft engagement element 504 and spacer 502 for receiving and securing golf shaft 20. In addition, outer sleeve portion 506 of spacer 502 includes chamfer 507 to provide a safer, more durable, and/or more aesthetic construction for outer sleeve portion 506, which is exposed on an exterior of the golf club when it is assembled in the operating position.

As shown in FIG. 6B, spacer 502 shrouds or encircles a lower portion of shaft engagement element 504 with outer sleeve portion 506, and also shrouds or encircles an upper portion of hosel insert 509 with hosel contact portion 510. In addition, spacer 502 shrouds or encircles an extreme tip portion of golf shaft 20 when located in annular groove 516. Coupling 500 may be bonded to golf shaft 20 by, for example, gluing shaft engagement element 504 into shaft internal bore 22 and/or gluing golf shaft 20 into annular groove 516. In other implementations, shaft engagement element 504 may be frictionally fitted into shaft internal bore 22. Such implementations may also allow for the addition and removal of coupling 500 or a golf club shaft by a golfer or retailer in the field.

Shaft engagement element 504 fits within shaft internal bore 22 of golf shaft 20 with the tip portion of golf shaft 20 interiorly contacted or supported by shaft engagement element 504 and partially exteriorly contacted or supported by annular groove 516 of spacer 502. Shaft engagement element 504 is also in contact with interior surface 512 of spacer 502.

Hosel insert 509 is configured to fit within a hosel internal bore (e.g., hosel internal bore 14 in FIG. 1C). Hosel insert 509 may be bonded with a hosel, for example, by gluing hosel insert 509 into the hosel internal bore. In other implementations, hosel insert 509 may be frictionally fitted into the hosel. Such implementations may also allow for the addition and removal of coupling 500 or a golf club head by a golfer or retailer in the field.

Figure 7A:
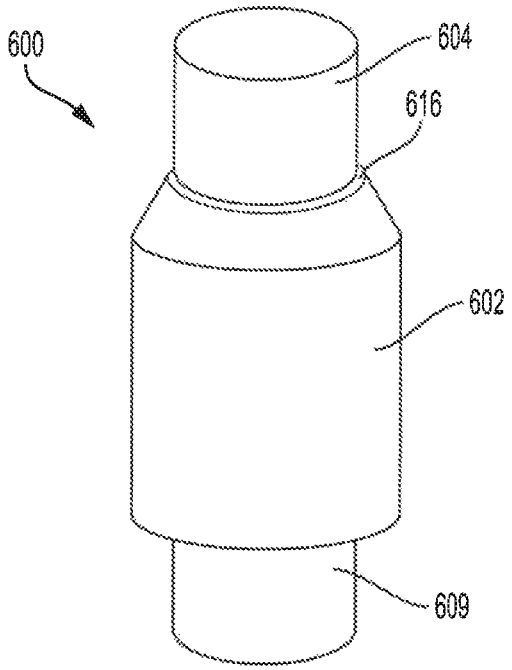
FIG. 7A is a perspective view of a coupling for securing a golf shaft to a golf club head according to an embodiment.

FIG. 7A is a perspective view of coupling 600 for securing golf shaft 20 to golf club head 10 according to an embodiment. FIG. 7B provides a cross-section view of coupling 600 along cross-section line 7B in FIG. 7A when in contact with golf shaft 20. As shown in FIGS. 7A and 7B, coupling 600 includes shaft engagement element 604, spacer 602, and a third component, hosel insert 609. In some implementations, hosel insert 609 can be made of a material with a different Young's modulus than the materials used for spacer 602 and/or shaft engagement element 604. In such implementations, the Young's modulus of the material used for hosel insert 609 can be greater than the Young's modulus of the material used for spacer 602 to provide for added bending stiffness in the connection between coupling 600 and the hosel. In some implementations, hosel insert 609 and shaft engagement element 604 may be made of the same material.

Figure 7C:
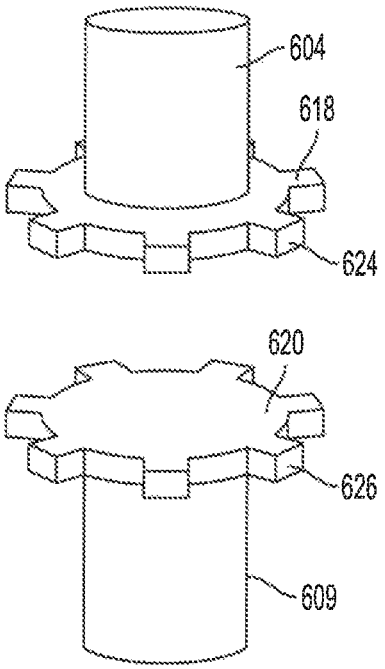
FIG. 7C is a perspective view of certain components of the coupling of FIGS. 7A and 7B in isolation.
Figure 7B:
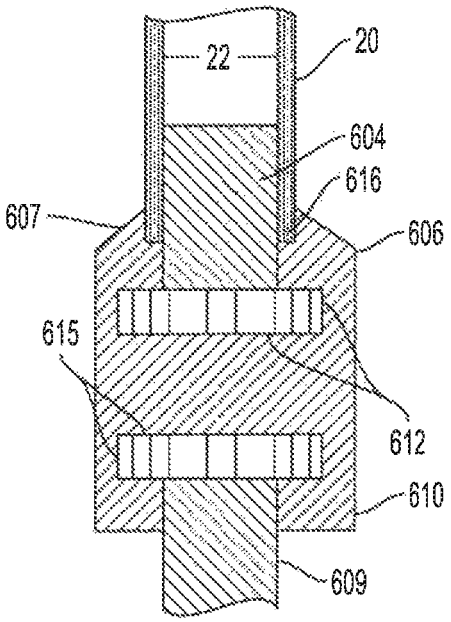
FIG. 7B is a cross-section view of the coupling of FIG. 7A taken through its central longitudinal axis and in contact with a golf shaft.

FIG. 7C is a perspective view of shaft engagement element 604 and hosel insert 609 in isolation (for purposes of showing further detail). Unlike coupling 500 shown in FIGS. 6A and 6B discussed above, shaft engagement element 604 and hosel insert 609 include radial projections 624 and 626, respectively, for improved adhesion with spacer 602. In addition, shaft engagement element 604 and hosel insert 609 include flange portions 618 and 620, respectively, for improved adhesion or frictional contact with spacer 602. As will be appreciated by those of ordinary skill in the art, a flange portion and/or radial projections may be omitted from one or both of shaft engagement element 604 and hosel insert 609 in other embodiments.

As with shaft engagement element 104 and spacer 102 of coupling 100 in FIGS. 2A and 2B discussed above, the material used for spacer 602 can have a lower Young's modulus than the Young's modulus for a material used for shaft engagement element 604. The same ratios, limits, and preferred ranges for the Young's moduli of the materials used for spacer 102 and shaft engagement element 104 discussed above for coupling 100 may be used in selecting materials for spacer 602 and shaft engagement element 604 of coupling 600. For example, the material for shaft engagement element 604 may be selected from steel, stainless steel, titanium, titanium alloy, aluminum, zinc, and copper. Similarly, the material for spacer 602 may be selected from an elastomer, a natural rubber, a synthetic rubber, a polyurethane, an acetal resin, a thermoplastic material, a polyamide, and a fiber-reinforced resin.

Spacer 602 may be bonded to shaft engagement element 604 and hosel insert 609 by co-molding spacer 602 with shaft engagement element 604 and hosel insert 609 during a molding process. In other implementations, spacer 602 may be bonded to shaft engagement element 604 and hosel insert 609 by, for example, gluing along interior surfaces 612 and 615 of spacer 602.

As shown in FIGS. 7A and 7B, coupling 600 includes annular groove 616 between shaft engagement element 604 and spacer 602 for receiving and securing golf shaft 20. In addition, outer sleeve portion 606 of spacer 602 includes chamfer 607 to provide a safer, more durable, and/or more aesthetic construction for outer sleeve portion 606, which is exposed on an exterior of the golf club when it is assembled in the operating position.

As shown in FIG. 7B, spacer 602 shrouds or encircles a lower portion of shaft engagement element 604 and flange 618 with outer sleeve portion 606, and also shrouds or encircles an upper portion of hosel insert 609 and flange 620 with hosel contact portion 610. In addition, spacer 602 shrouds or encircles an extreme tip portion of golf shaft 20 when located in annular groove 616. Coupling 600 may be bonded to golf shaft 20 by, for example, gluing shaft engagement element 604 into shaft internal bore 22 and/or gluing golf shaft 20 into annular groove 616. In other implementations, shaft engagement element 604 may be frictionally fitted into shaft internal bore 22. Such implementations may also allow for the addition and removal of coupling 600 or a golf club shaft by a golfer or retailer in the field.

Shaft engagement element 604 fits within shaft internal bore 22 of golf shaft 20 with the tip portion of golf shaft 20 interiorly contacted or supported by shaft engagement element 604 and partially exteriorly contacted or supported by annular groove 616 of spacer 602. Shaft engagement element 604 is also in contact with interior surface 612 of spacer 602.

Hosel insert 609 is configured to fit within a hosel internal bore (e.g., hosel internal bore 14 in FIG. 1C). Hosel insert 609 may be bonded with a hosel, for example, by gluing hosel insert 609 into the hosel internal bore. In other implementations, hosel insert 609 may be frictionally fitted into the hosel. Such implementations may also allow for the addition and removal of coupling 600 or a golf club head by a golfer or retailer in the field.

Figure 8A:
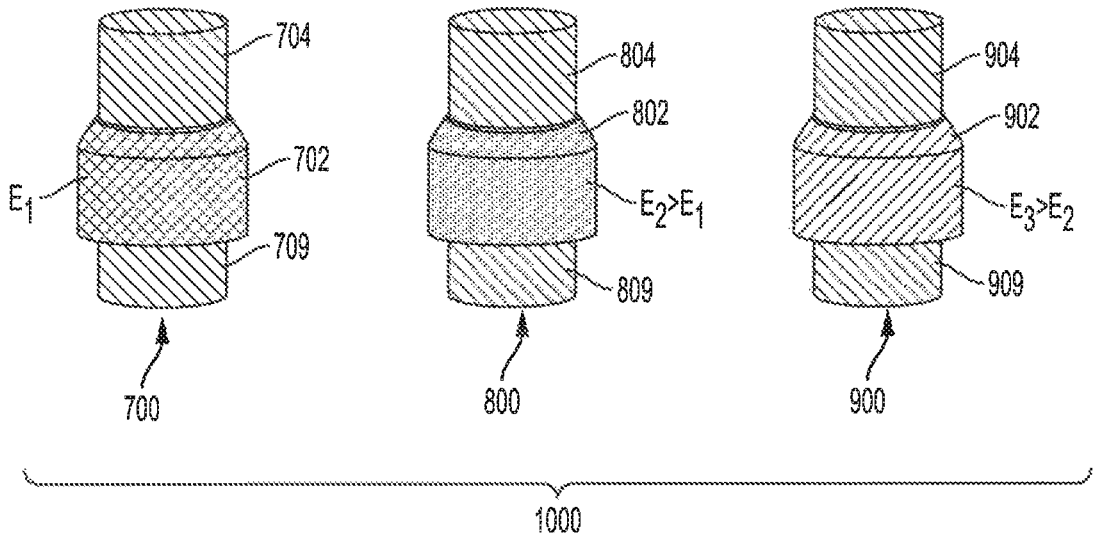
FIG. 8A is a perspective view of a kit of couplings with each coupling including a vibration dampening element comprising a different material according to an embodiment.
Figure 8B:
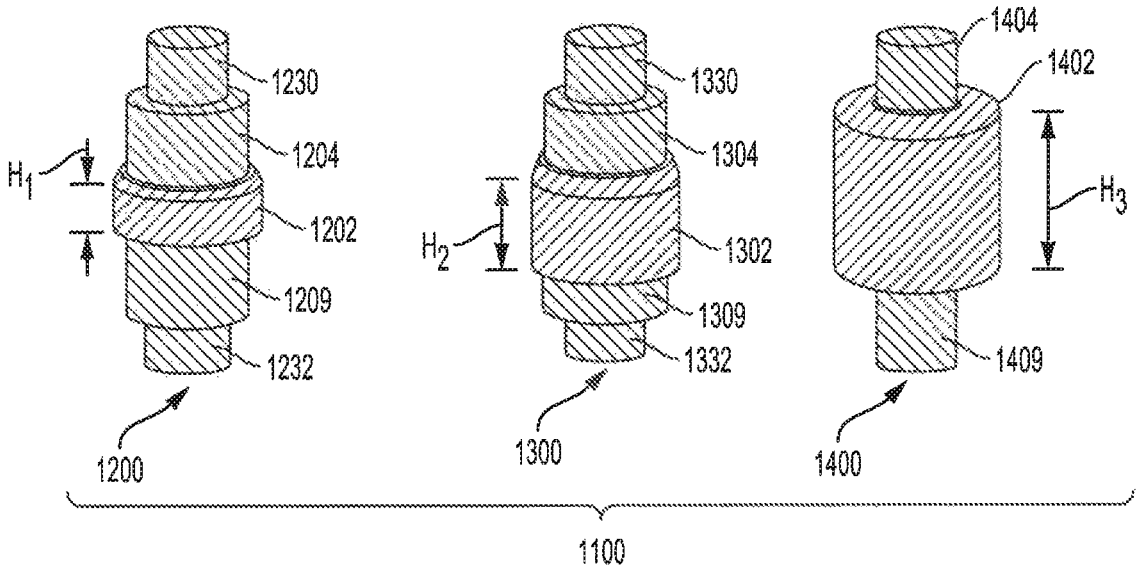
FIG. 8B is a perspective view of a kit of couplings with each coupling including a vibration dampening element having a different structural configuration according to an embodiment.
Figure 8C:
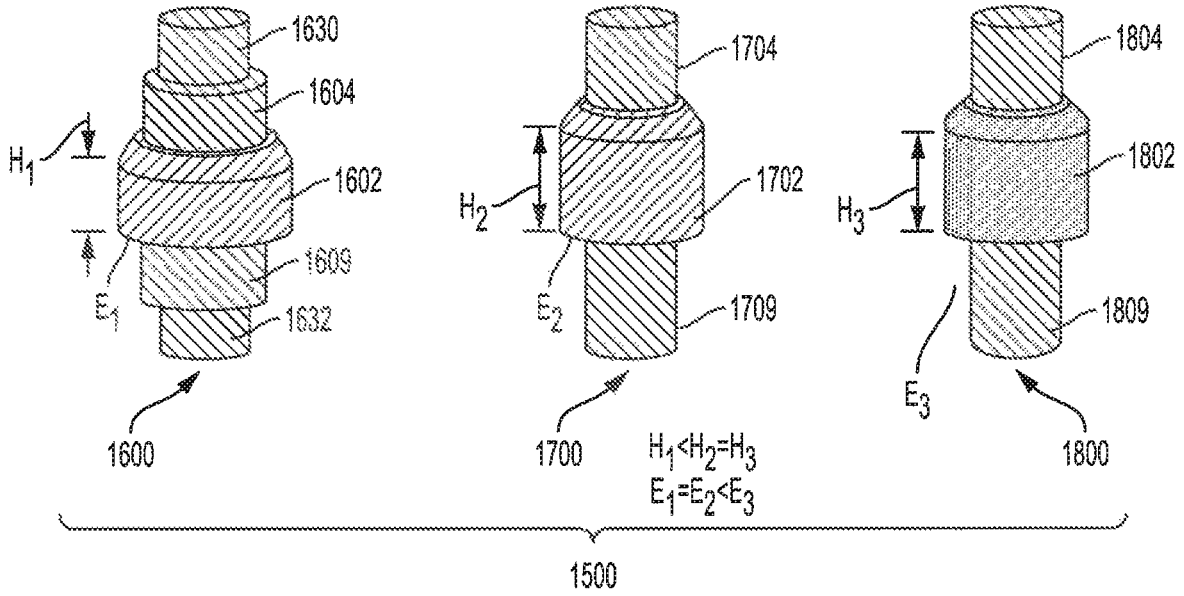
FIG. 8C is a perspective view of a kit of couplings with each coupling including a vibration dampening element that differs from another coupling's vibration dampening element with respect to a structural configuration or a material according to an embodiment.

FIGS. 8A to 8C provide examples of kits including different couplings to adjust the feel or vibration response of a golf club. The example couplings of FIGS. 8A to 8C are substitutably securable to one or more different pairs of golf club heads and golf shafts. In some implementations, the shaft engagement elements and hosel inserts or spacers may fit a standardized shaft internal bore size and a standard hosel internal bore size to allow the couplings in the kits to be used interchangeably with golf clubs of different golf club manufacturers. The selection of a coupling from a kit for a golf club head and a golf shaft can be made by, for example, a golf club manufacturer upon request, such as with a customized order from a particular golfer or retailer for a certain level of feel (e.g., soft, medium, or hard). In other examples, a golfer may separately purchase a kit of couplings and select a coupling dependent on course conditions (e.g., a "stump" or "speed" of a putting green) and secure or have a retailer secure the coupling to a golf shaft and golf club head. In this regard, the couplings in the kits of FIGS. 8A to 8C may include indicators of the dampening or feel provided by the coupling, such as by using a different color coding to identify soft (greatest dampening), medium (in between amount of dampening), and hard (least dampening) feels.

FIG. 8A is a perspective view of a first example kit 1000 of couplings with each coupling including a vibration dampening element comprising a different material according to an embodiment. As shown in FIG. 8A, kit 1000 includes couplings 700, 800, and 900. Couplings 700, 800, and 900 include shaft engagement elements 704, 804, and 904, respectively, configured to contact, and engage with, a golf shaft. Couplings 700, 800, and 900 also include hosel engagement elements 709, 809, and 909, respectively, configured to contact, and engage with, a hosel of a golf club head.

In addition, couplings 700, 800, and 900 include vibration dampening elements 702, 802, and 902, respectively, bonded to the shaft engagement element to serve as a spacer by spacing the engagement element from a golf club head in an operating position. As with the embodiments of couplings discussed above, vibration dampening elements 702, 802, and 902 are configured to isolate the engagement element from a golf club head when in an operating position. In this regard, when the couplings are operably secured to a golf shaft and a golf club head, the golf shaft is located entirely above the golf club head.

As shown in FIG. 8A, vibration dampening elements 702, 802, and 902 are made of materials having different Young's moduli. In more detail, the Young's modulus for vibration dampening element 802 ($E_2$) is greater than the Young's modulus for vibration dampening element 702 ($E_1$), and the Young's modulus for vibration dampening element 902 ($E_3$) is greater than the Young's modulus for vibration dampening element 802 ($E_2$). This variety of materials used for vibration dampening elements in kit 1000 ordinarily allows for varying amounts of frequency attenuation or levels of feel without changing the structural configurations among couplings 700, 800, and 900. In some implementations, the materials used for vibration dampening elements 702, 802, and 902 can be selected from, for example, an elastomer, a natural rubber, a synthetic rubber, a polyurethane, an acetal resin, a thermoplastic material, a polyamide, and a fiber-reinforced resin.

FIG. 8B is a perspective view of kit 1100 with each coupling in the kit including a vibration dampening element having a different structural configuration according to an embodiment. In this regard, other embodiments of kit 1100 may include a variety of structural configurations in common or similar to various couplings discussed above with reference to FIGS. 1A to 7C. As shown in FIG. 8B, kit 1100 includes couplings 1200, 1300, and 1400. Couplings 1200, 1300, and 1400 include shaft engagement elements 1204, 1304, and 1404, respectively, configured to contact, and engage with, a golf shaft. Couplings 1200, 1300, and 1400 also include hosel engagement elements 1209, 1309, and 1409, respectively, configured to contact, and engage with, a hosel of a golf club head.

In addition, couplings 1200, 1300, and 1400 include vibration dampening elements 1202, 1302, and 1402, respectively, bonded to the shaft engagement element to serve as a spacer by spacing the engagement element from a golf club head in an operating position. As with the embodiments of couplings discussed above, vibration dampening elements 1202, 1302, and 1402 are configured to isolate the engagement element from a golf club head when in an operating position. In this regard, when the couplings are operably secured to a golf shaft and a golf club head, the golf shaft is located entirely above the golf club head.

As shown in FIG. 8B, couplings 1200 and 1300 include inserts extending from center portions of the shaft engagement elements and hosel engagement elements. Coupling 1200 includes upper insert 1230 extending from a center portion of shaft engagement element 1204 and lower insert 1232 extending from a center portion of hosel engagement element 1209. Coupling 1300 includes upper insert 1330 extending from a center portion of shaft engagement element 1304 and lower insert 1332 extending from a center portion of hosel engagement element 1309. In some implementations, upper inserts 1230 and 1330 can form a single component or pin with lower inserts 1232 and 1332, respectively, that extend through respective center portions of couplings 1200 and 1300. These inserts may allow for the use of a different material within the shaft engagement element and/or the hosel engagement element to affect the bending stiffness or strength of the coupling. In the example of coupling 1400, shaft engagement element 1404 and hosel engagement element 1409 may form a single component or pin that extends through a center portion of vibration dampening element 1402.

Vibration dampening elements 702, 802, and 902 have different structural configurations that can allow for different amounts of vibration attenuation or different feels. In more detail, a cylinder height of vibration dampening element 1302 ($H_2$) is greater than a cylinder height of vibration dampening element 1202 ($H_1$), and the cylinder height of vibration dampening element 1402 ($H_3$) is greater than the cylinder height of vibration dampening element 1302 ($H_2$). This variety of structural configurations for vibration dampening elements in kit 1100 ordinarily allows for varying amounts of frequency attenuation or levels of feel without changing the material used for vibration dampening elements 1202, 1302, and 1402. As will be appreciated by those of ordinary skill in the art, other structural configuration differences among vibration dampening elements 1202, 1302, and 1402 are possible in other implementations.

FIG. 8C is a perspective view of kit 1500 with each coupling in the kit including a vibration dampening element that differs from another coupling's vibration dampening element with respect to a structural configuration or a material according to an embodiment. As shown in FIG. 8C, kit 1500 includes couplings 1600, 1700, and 1800. Couplings 1600, 1700, and 1800 include shaft engagement elements 1604, 1704, and 1804, respectively, configured to contact, and engage with, a golf shaft. Couplings 1600, 1700, and 1800 also include hosel engagement elements 1609, 1709, and 1809, respectively, configured to contact, and engage with, a hosel of a golf club head.

In addition, couplings 1600, 1700, and 1800 include vibration dampening elements 1602, 1702, and 1802, respectively, bonded to the shaft engagement element to serve as a spacer by spacing the engagement element from a golf club head in an operating position. As with the embodiments of couplings discussed above, vibration dampening elements 1602, 1702, and 1802 are configured to isolate the engagement element from a golf club head when in an operating position. In this regard, when the couplings are operably secured to a golf shaft and a golf club head, the golf shaft is located entirely above the golf club head.

As shown in FIG. 8C, coupling 1600 includes upper insert 1630 extending from a center portion of shaft engagement element 1604 and lower insert 1632 extending from a center portion of hosel engagement element 1609. In some implementations, upper insert 1630 and lower insert 1632 can form a single component or pin that extends through a center portion of coupling 1600. The insert or inserts may allow for the use of a different material within shaft engagement element 1604 and/or hosel engagement element 1609 to affect the bending stiffness or strength of the coupling in these locations. In the example of couplings 1700 and 1800, shaft engagement elements 1704 and 1804 may each form a single component or pin with hosel engagement elements 1709 and 1809, respectively, that extends through center portions of vibration dampening elements 1702 and 1802.

Each of vibration dampening elements 1602, 1702, and 1802 in kit 1500 has a different structural configuration or includes a different material from at least one other coupling in kit 1500. In this regard, vibration dampening elements 1602, 1702, and 1802 can vary with different combinations of structural configurations and material properties. In more detail, a cylinder height of vibration dampening element 1602 ($H_1$) is less than cylinder heights of vibration dampening elements 1702 ($H_2$) and 1802 ($H_3$), which equal each other. On the other hand, a Young's modulus of vibration dampening element 1802 ($E_3$) is greater than Young's moduli of vibration dampening elements 1602 ($E_1$) and 1702 ($E_2$), which equal each other. In some implementations, the materials used for vibration dampening elements 1602, 1702, and 1802 can be selected from, for example, an elastomer, a natural rubber, a synthetic rubber, a polyurethane, an acetal resin, a thermoplastic material, a polyamide, and a fiber-reinforced resin.

The variety of structural configurations and material properties for vibration dampening elements in kit 1500 ordinarily allows for varying amounts of frequency attenuation or levels of feel with more options for meeting bending stiffness or strength specifications. As will be appreciated by those of ordinary skill in the art, other structural configuration differences among vibration dampening elements 1602, 1702, and 1802 are possible in other implementations to fine-tune a frequency response of a golf club when hitting a golf ball.

Figure 9B:
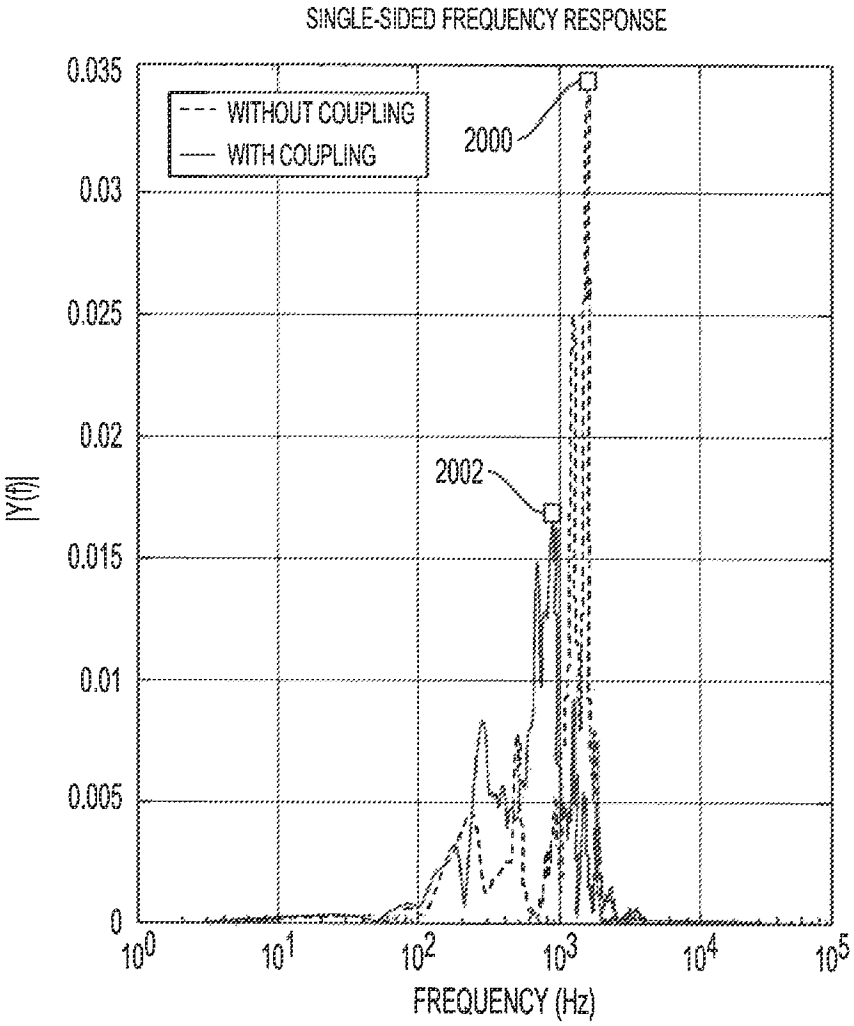
FIG. 9B is a graph comparing the frequency responses for the putters of FIG. 9A when hitting the golf ball.
Figure 9A:
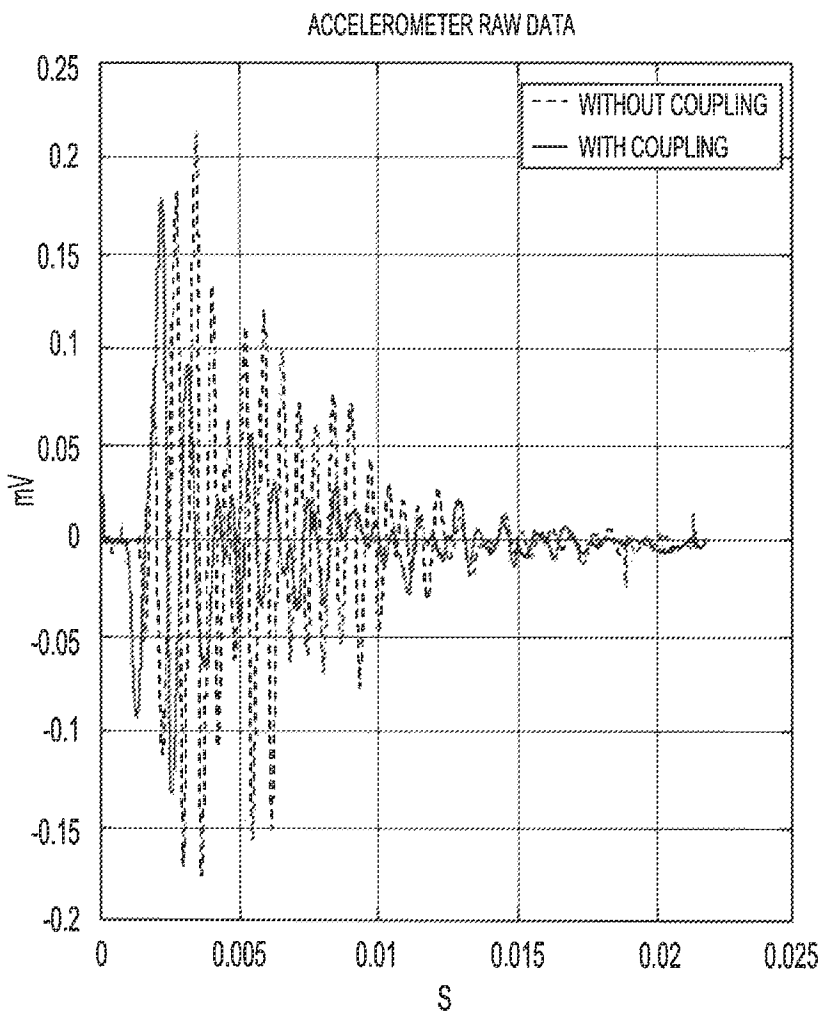
FIG. 9A is a graph comparing accelerometer data for a putter including a coupling and for a putter without a coupling when hitting a golf ball.

FIG. 9A is a graph comparing accelerometer data for a putter including a coupling as described above with reference to FIGS. 2A and 2B, and for a putter without such a coupling when hitting a golf ball. The coupling used for the putter includes a shaft engagement element configured to contact, and engage with, the golf shaft of the putter, and a spacer bonded to the shaft engagement element. The spacer comprises a material having a Young's modulus less than the shaft engagement element, and is operationally secured so that the golf shaft is located above the golf club head in its entirety.

In measuring the effect of using a coupling as described above, two otherwise identical golf putter models are used with an accelerometer mounted on a butt-end of the grip of the golf shaft to sense accelerations caused by vibration along the golf shaft. A robot is then used to consistently impact a golf ball with each putter. The golf ball is placed on a tee so that the impact location is near a center of a strike face of each golf club head. The raw accelerometer data is shown in FIG. 9A for 2 ms prior to impact and 20 ms after impact for each putter.

As shown in FIG. 9A, the putter with the coupling has distinctly different vibration characteristics. In particular, the acceleration response to the impact decays quicker for the putter with the coupling and does not reach as high of an acceleration when impacting the golf ball at approximately 2 ms.

FIG. 9B is a graph comparing the frequency responses for the putters of FIG. 9A when hitting the golf ball. The frequency responses shown in FIG. 9B result from performing a Fast Fourier Transform (FFT) on the raw accelerometer data of FIG. 9A and plotting the responses on a logarithmic scale along the x-axis for frequency. As shown in FIG. 9B, there is a difference in primary mode frequencies and the maximum amplitudes for the frequency responses. The putter without the coupling has a primary frequency of 1587 Hz corresponding to point 2000 in FIG. 9B, with another significant peak at a slightly lower frequency. The putter with the coupling, on the other hand, has a peak frequency at 937 Hz corresponding to point 2002 in FIG. 9B at a significantly lower amplitude.

The vibration dampening elements or spacers in the couplings described above can attenuate high frequency vibrations to provide a softer feel when contacting a golf ball, while the shaft engagement elements can provide a bending stiffness for the coupling that is comparable to the tip of a golf shaft. In addition, the above described couplings can ordinarily allow for a fine tuning of a golf club's feel, without having to solely rely upon golf club head face inserts or milling, which may not be as easy to customize for vibration dampening.

The foregoing description of the disclosed example embodiments is provided to enable any person of ordinary skill in the art to make or use the embodiments in the present disclosure. Various modifications to these examples will be readily apparent to those of ordinary skill in the art, and the principles disclosed herein may be applied to other examples without departing from the spirit or scope of the present disclosure. For example, some alternative embodiments may include a coupling allowing for some contact between a golf shaft and a golf club head while including a vibration dampening material with a lower Young's modulus than a shaft engagement portion of the coupling. Accordingly, the described embodiments are to be considered in all respects only as illustrative and not restrictive, and the scope of the disclosure is, therefore, indicated by the following claims rather than by the foregoing description. All changes which come within the meaning and range of equivalency of the claims are to be embraced within their scope.

What is claimed is:

1. A coupling for securing a golf club shaft to a golf club head, the coupling when in an operating position comprising:

a first component configured to contact, and engage with, a tip end of the golf club shaft, the first component comprising a first material having a first Young's modulus; and a second component configured to space the first component from the golf club head and comprising:

a second material having a second Young's modulus less than the first material, the second Young's modulus being no greater than 10 GPa;

a hosel engagement portion; and an outer sleeve portion that extends radially from the hosel engagement portion, wherein, the first component is disposed between the tip end of the shaft and the second component.

2. The coupling of claim 1, wherein the coupling when in the operating position is configured to position the golf club shaft entirely above the golf club head.

3. The coupling of claim 1, wherein the second Young's modulus is no greater than 5 GPa.

4. The coupling of claim 1, wherein the second material has a hardness no less than Shore 20D.

5. The coupling of claim 4, wherein the second material has a hardness of Shore 20D to 70D.

6. The coupling of claim 1, wherein a ratio of the first Young's modulus to the second Young's modulus is no less than 15.

7. The coupling of claim 6, wherein the ratio of the first Young's modulus to the second Young's modulus is no less than 25.

8. A coupling for securing a golf club shaft to a golf club head, the coupling, when in an operating position, comprising:

a shaft engagement portion comprising a first material with a first Young's modulus and configured to engage with the golf club shaft; and a spacer configured to space the golf club shaft from the golf club head, the spacer comprising:

a second material having a second Young's modulus less than the first Young's modulus, the second Young's modulus being no greater than 10 GPa;

a hosel engagement portion configured to contact, and engage with, a hosel of the golf club head; and an outer sleeve portion that extends radially from the hosel engagement portion, wherein, the shaft engagement portion is disposed between the tip end of the shaft and the spacer.

9. The coupling of claim 8, wherein the coupling when in an operating position is configured to position the golf club shaft entirely above the golf club head.

10. The coupling of claim 8, wherein the second Young's modulus is no greater than 5 GPa.

11. The coupling of claim 8, wherein the second material has a hardness no less than Shore 20D.

12. The coupling of claim 11, wherein the second material has a hardness of Shore 20D to 70D.

13. The coupling of claim 12, wherein a ratio of the first Young's modulus to the second Young's modulus is no less than 15.

14. The coupling of claim 13, wherein the ratio of the first Young's modulus to the second Young's modulus is no less than 25.

15. The coupling of claim 8, wherein the second material is selected from the group consisting of: a natural rubber, a synthetic rubber, a polyurethane, an acetal resin, a thermoplastic material, a polyamide, and a fiber-reinforced resin.

16. A putter-type golf club that, when in an operating position, comprises:

a golf club head having a hosel;

a golf club shaft having a butt end and a tip end opposite the butt end; and a coupling for securing the golf club shaft to the golf club head, the coupling comprising:

a first component configured to contact, and engage with, the tip end of the golf club shaft, the first component comprising a first material having a first Young's modulus; and a second component configured to space the first component from the golf club head and comprising:

a second material having a second Young's modulus less than the first material, the second Young's modulus being no greater than 10 GPa;

a hosel engagement portion; and an outer sleeve portion that extends radially from the hosel engagement portion, wherein, in the operating position, the first component is disposed between the tip end of the shaft and the second component.

* * * * *